US008141989B2

(12) United States Patent
Kim et al.

(10) Patent No.: US 8,141,989 B2
(45) Date of Patent: Mar. 27, 2012

(54) INK-JET HEAD AND METHOD FOR MANUFACTURING THE SAME

(75) Inventors: Sang-Jin Kim, Seoul (KR); Young-Seuck Yoo, Seoul (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 369 days.

(21) Appl. No.: 12/505,291

(22) Filed: Jul. 17, 2009

(65) Prior Publication Data

US 2010/0220156 A1 Sep. 2, 2010

(30) Foreign Application Priority Data

Feb. 27, 2009 (KR) ..... 10-2009-0017083

(51) Int. Cl.
*B41J 2/045* (2006.01)

(52) U.S. Cl. ..... 347/68; 347/70

(58) Field of Classification Search ..... None
See application file for complete search history.

(56) References Cited

FOREIGN PATENT DOCUMENTS

| | | | |
|---|---|---|---|
| JP | 06134983 A | * | 5/1994 |
| JP | 3171958 | | 3/2001 |
| JP | 3460218 | | 8/2003 |

OTHER PUBLICATIONS

Korean Office Action, w/ English translation thereof, issued in Korean Patent Application No. KR 10-2009-0017083 dated Jan. 19, 2011.

Japanese Office Action, w/ partial English translation thereof, issued in Japanese Patent Application No. JP 2009-173256 dated Jun. 14, 2011.

* cited by examiner

*Primary Examiner* — Matthew Luu
*Assistant Examiner* — Lisa M Solomon
(74) *Attorney, Agent, or Firm* — McDermott Will & Emery LLP

(57) ABSTRACT

An ink-jet head and a method for manufacturing the ink-jet head are disclosed. The ink-jet head can include: a chamber, which may house a type of ink; a membrane, which may be formed on one side of the chamber, and in a surface of which a holding cavity may be formed; a lower electrode, formed on an inner surface of the holding cavity; and a piezoelectric component, held in the holding cavity. According to certain embodiments of the invention, the ink-jet head can be formed with thin-film type actuators, and the electrical properties of the ink-jet head can be improved.

9 Claims, 18 Drawing Sheets

INK-JET HEAD AND METHOD FOR MANUFACTURING THE SAME

CROSS-REFERENCE TO RELATED APPLICATIONS

This application claims the benefit of Korean Patent Application No. 10-2009-0017083, filed with the Korean Intellectual Property Office on Feb. 27, 2009, the disclosure of which is incorporated herein by reference in its entirety.

BACKGROUND

1. Technical Field

The present invention relates to an ink-jet head and to a method of manufacturing the ink-jet head.

2. Description of the Related Art

An ink-jet printer is a device that performs a printing operation by converting electrical signals into physical forces to eject ink droplets through nozzles. An ink-jet head can be manufactured by processing various parts, such as the chamber, restrictor, nozzle, etc., in a number of layers and then attaching the layers together.

An actuator can be coupled to one side of the chamber, and as the ink-jet head applies pressure, the ink held in the chamber may be ejected. The actuator can include a piezoelectric component as well as an upper electrode and a lower electrode that provide the piezoelectric component with an electrical connection.

In recent times, application of the ink-jet head has expanded beyond the graphic printing industry to manufacturing electronic parts, such as printed circuit boards, LCD panels, etc.

In this context, the actuator is an important element that can determine the ejection properties of the ink jet head. An ideal actuator may provide a greater displacement and may require a lower operating voltage, to facilitate the production of the operation circuits. An ideal actuator may also be implemented with a low thickness, for example, in the form of a thin film.

SUMMARY

An aspect of the invention is to provide an ink-jet head, and a method of manufacturing the ink-jet head, implemented with thinner actuators.

Another aspect of the invention provides an ink-jet head that includes: a chamber, which may house a type of ink; a membrane, which may be formed on one side of the chamber, and in a surface of which a holding cavity may be formed; a lower electrode, formed on an inner surface of the holding cavity; and a piezoelectric component, held in the holding cavity.

In certain embodiments, the piezoelectric component can be held in the holding cavity such that one side of the lower electrode is exposed. The ink-jet head can further include a connector that has one end extending to a point that is level with the surface of the ink-jet head in which the membrane is formed and the other end coupled to one side of the lower electrode. The piezoelectric component can be held in the holding cavity such that both sides of the lower electrode are exposed, in which case the other ends of two connectors can be coupled to both sides of the lower electrode respectively.

An upper surface of the piezoelectric component and one end of the connector can be formed on a plane that is level with the surface of the ink-jet head in which the membrane is formed. The ink-jet head can then further include an upper electrode, which may be coupled onto the piezoelectric component; and a ground, which may be formed on the surface of the ink jet head in which the membrane is formed, in such a way that the ground is coupled to one end of the connector.

Yet another aspect of the invention provides a method for manufacturing an ink-jet head that has a membrane formed on one side of a chamber housing ink. The method includes: forming a holding cavity in one surface of the ink-jet head in which the membrane is formed; forming a lower electrode on an inner surface of the holding cavity; and mounting a piezoelectric component in the holding cavity.

Here, the operation of mounting the piezoelectric component can be performed such that one side of the lower electrode is exposed, and the method for manufacturing an ink-jet head can include an additional operation, after the mounting of the piezoelectric component, of forming a connector on one side of the lower electrode by performing electroplating.

The operation of forming the lower electrode can be performed by depositing a conductive material on the surface of the ink-jet head in which the membrane is formed, and the method for manufacturing an ink jet head can include an additional operation, after the forming of the connector, of abrading one surface of the piezoelectric component and the surface of the ink-jet head in which the membrane is formed such that one end of the connector is exposed.

In certain embodiments, the method for manufacturing an ink-jet head can include, after the abrading: forming an upper electrode on the piezoelectric component; and forming a ground on the surface of the ink-jet head in which the membrane is formed, such that the ground is coupled to the one end of the connector.

The abrading operation can be performed such that the one surface of the piezoelectric component, the one end of the connector, and the one surface of the ink-jet head in which the membrane is formed are level with one another.

The operation of forming the holding cavity may be performed by etching the surface of the ink jet head.

Additional aspects and advantages of the present invention will be set forth in part in the description which follows, and in part will be obvious from the description, or may be learned by practice of the invention.

DETAILED DESCRIPTION

Figure 1:
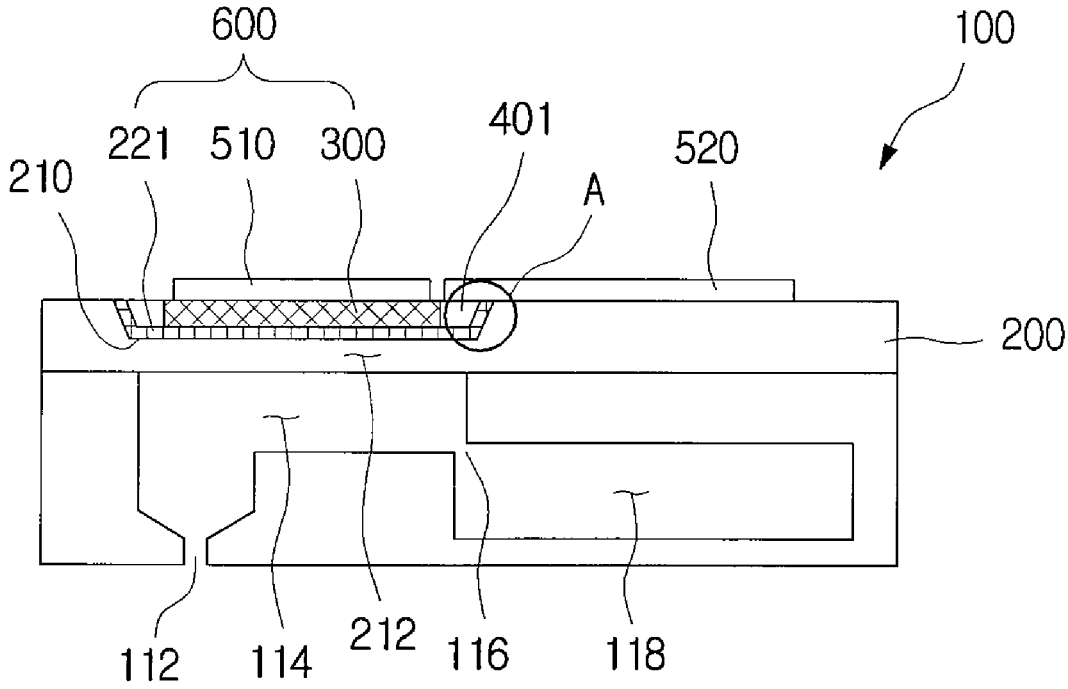
FIG. 1 is a side cross-sectional view of an ink-jet head according to an embodiment of the invention.

An ink-jet head and method for manufacturing the ink-jet head according to certain embodiments of the invention will be described below in more detail with reference to the accompanying drawings. Those elements that are the same or are in correspondence are rendered the same reference numeral regardless of the figure number, and redundant descriptions are omitted.

Figure 2:
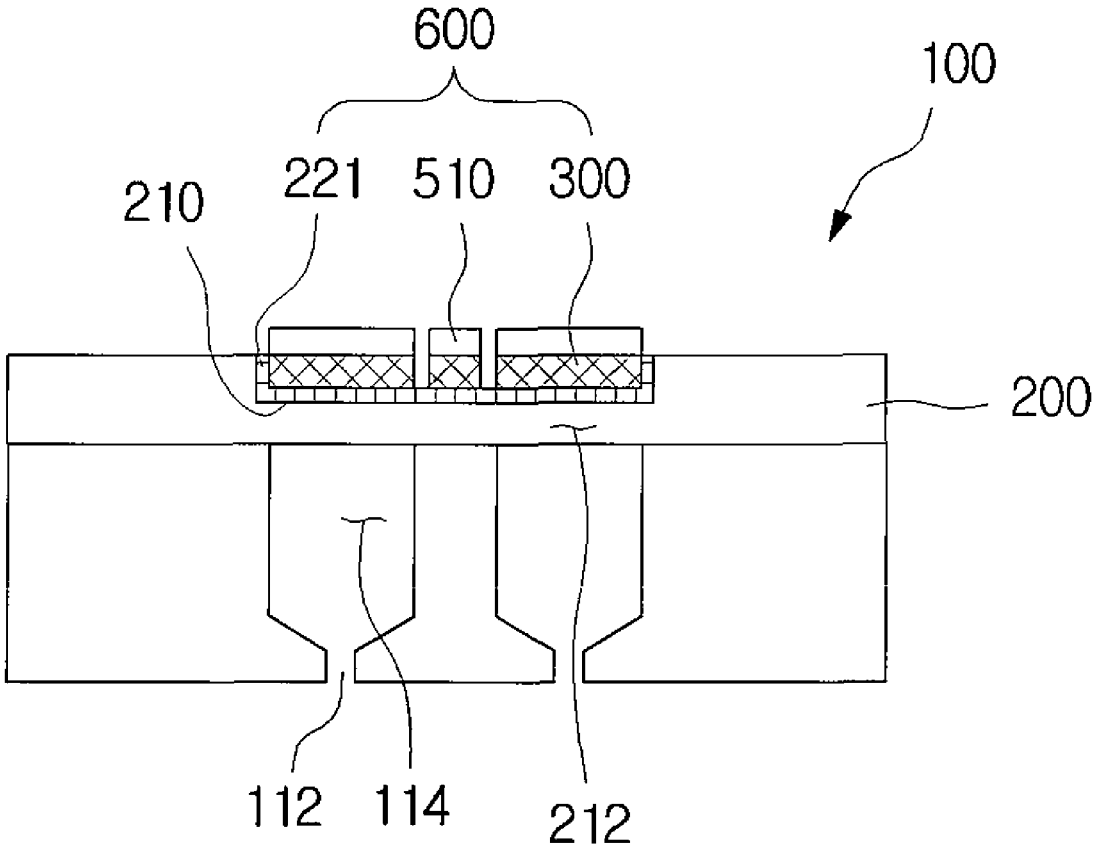
FIG. 2 is a front cross-sectional view of an ink-jet head according to an embodiment of the invention.
Figure 3:
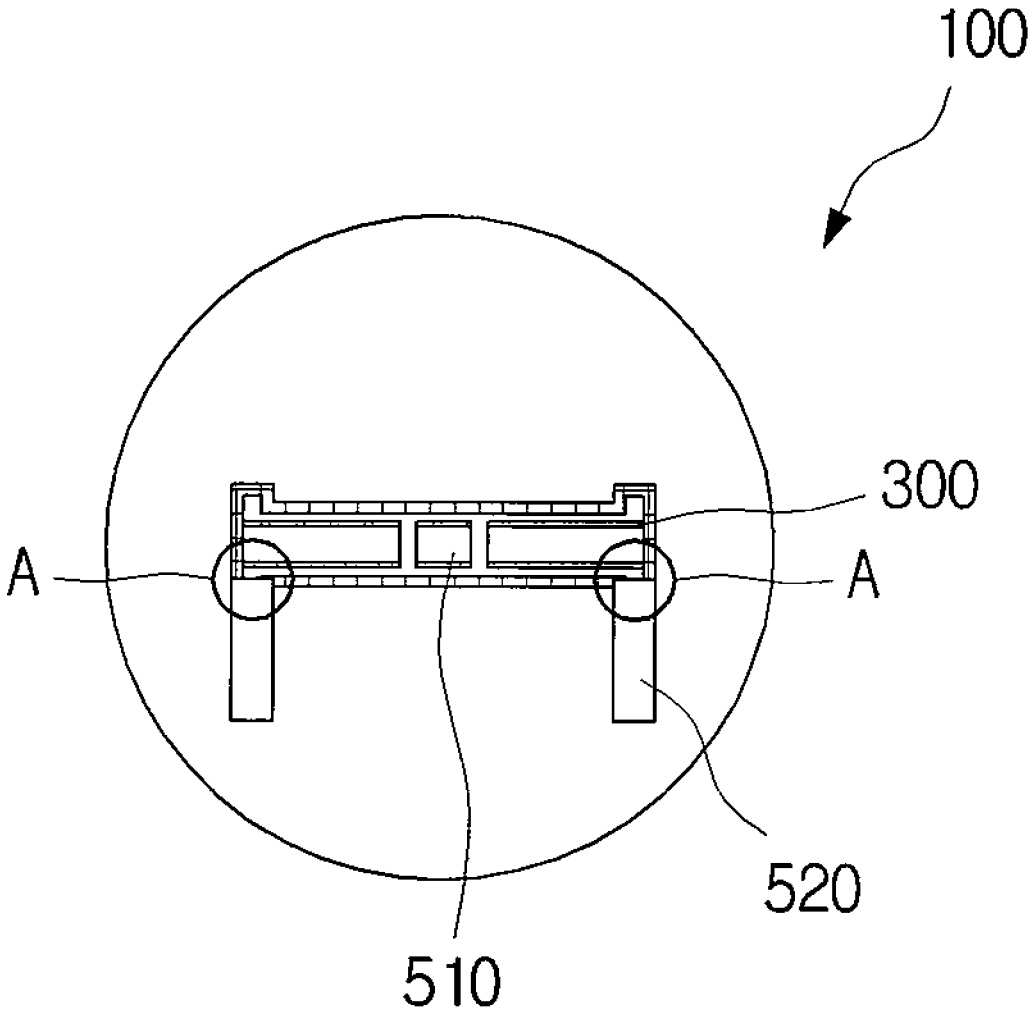
FIG. 3 is a plan view of an ink jet head according to an embodiment of the invention.

FIG. 1 is a side cross-sectional view of an ink jet head 100 according to an embodiment of the invention, and FIG. 2 is a front cross-sectional view of an ink-jet head 100 according to an embodiment of the invention. FIG. 3 is a plan view of an ink-jet head 100 according to an embodiment of the invention.

As in the example shown in FIG. 1 through FIG. 3, an ink jet head 100 according to an embodiment of the invention can include a chamber 114 in which ink may be held, a membrane 212 formed on one side of the chamber 114 that includes a holding cavity 210 in one surface, a lower electrode 221 formed on an inner surface of the holding cavity 210, and a piezoelectric component 300 held in the holding cavity 210. The ink-jet head 100 can be implemented with one or more actuators 600 having the form of thin films, to provide improved electrical properties in the ink-jet head 100.

Referring to FIG. 1, a chamber 114 can be formed in the ink jet head 100, providing a space in which the ink can be housed. At a lower side of the chamber 114, a nozzle 112 can be formed, through which the ink held in the chamber 114 may be ejected to the exterior of the ink jet head 100.

The chamber 114 can be connected by way of a restrictor 116 to a reservoir 118, in which the ink may be stored, to be supplied with the ink from the reservoir 118. As in the example shown in FIG. 2, a multiple number of chambers 114 can be formed, and the reservoir 118 can be connected to multiple chambers 114 to provide ink to each of the chambers 114.

On one side of the reservoir 118, an inlet (not shown) may be formed through which ink may be supplied from outside the ink-jet head 100. Restrictors 116 can be positioned between the chamber 114 and the reservoir 118, providing a channel through which the ink in the reservoir 118 may be supplied to the chamber 114.

The membrane 212 can be formed on the side of the chamber 114 across from the nozzle 112. The membrane 212 may be used as a vibration plate for transferring vibrations generated by an actuator 600 to the chamber 114.

The actuator 600 can include a piezoelectric component 300, as well as a lower electrode 221 coupled to a lower surface of the piezoelectric component 300 and an upper electrode 510 coupled to an upper surface of the piezoelectric component 300 for providing an electrical connection to the piezoelectric component 300.

When the actuator 600 is operated, the shape of the membrane 212 may be changed, and thus the volume inside the chamber 114 may be changed. As a result, the ink held in the chamber 114 may be ejected through the nozzle 112.

A holding cavity 210 can be formed in an upper surface of the membrane 212. The holding cavity 210 may provide a space in which to hold the piezoelectric component 300 and the lower electrode 221, which will be described later in more detail. The holding cavity 210 can form a structure by which the piezoelectric component 300 may be held in a surface of the ink-jet head 100 where the membrane 212 is formed. Thus, the surface of the ink jet head 100 and the piezoelectric component 300 may be abraded together to modify the thickness of the piezoelectric component 300.

As such, it can be easier to implement the ink-jet head 100 with a much thinner piezoelectric component 300. Also, with the piezoelectric component 300 supported on both sides, the piezoelectric component 300 and the ink-jet head 100 can readily be kept in alignment, as illustrated in FIG. 2, during the process of abrading the piezoelectric component 300 and the surface of the ink-jet head 100.

The lower electrode 221 can be formed on an inner surface of the holding cavity 210. As in the example shown in FIG. 2, the lower electrode 221 can provide electrical connection to a number of independent piezoelectric components 300 collectively. The lower electrode 221 can be formed along the bottom and lateral surfaces of the holding cavity 210 to be in contact with a bottom surface of the piezoelectric component 300.

As illustrated in FIG. 3, the holding cavity 210 can generally extend from one side to the other side of the ink-jet head 100. Provided at either end of the holding cavity 210 may be a space that extends along each side of the lower electrode 221, i.e. in a direction along the front to back of the holding cavity 210. The portions extending to the back (portions A in FIG. 1 and FIG. 3) may each expose one side of the lower electrode 221.

A connector 401 can have one end extend to a point level with the surface of the ink-jet head 100 in which the membrane 212 is formed, so as to provide an electrical connection between the lower electrode 221 and a ground 520. The connector 401 can have the other end coupled to the one side of the lower electrode 221 that is not covered by the piezoelectric component 300.

The connector 401 can be formed along the inner wall of the holding cavity 210, in each of the portions extending front and back at either end of the holding cavity 210. The connector 401 can be made from a conductive metal to electrically connect the lower electrode 221 to the ground 520 formed on the surface of the ink-jet head 100.

The ground 520 can be electrically connected with the lower electrode 221 and can form an electrical connection between the piezoelectric component 300 and an external grounding electrode.

Thus, the ground 520 may provide a means to form an electrical connection with the lower electrode 221 of the piezoelectric component 300 held in the holding cavity 210. In cases where the heights of the upper surfaces of the piezoelectric components 300 are equal to the level of the surface of the ink-jet head 100 in which the membrane 212 is formed, the upper electrodes 510 formed respectively over the piezoelectric components 300 for providing electrical connection can be formed simultaneously with the grounds 520, to shorten the manufacturing process and improve productivity.

Also, in cases where the upper electrodes 510 are formed as thick films, temperature increases can be evenly distributed over all of the upper electrodes 510, when the upper electrodes 510 are electrically connected with wires. This can improve the structural coupling between the wires and the upper electrodes 510 and can hence improve the reliability of the electrical connections.

Figure 4:
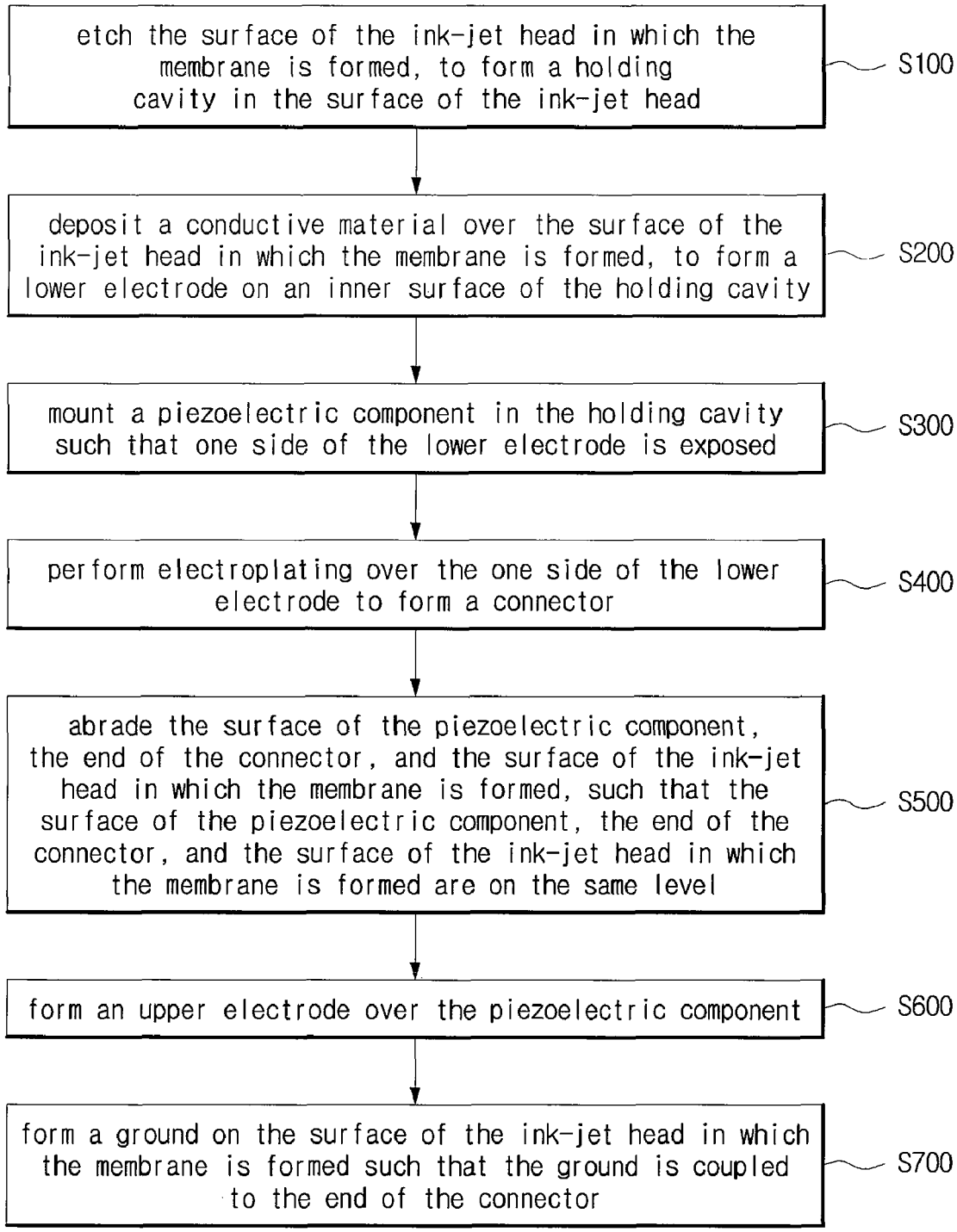
FIG. 4 is a flowchart illustrating a method for manufacturing an ink-jet head according to another embodiment of the invention.

FIG. 4 is a flowchart illustrating a method for manufacturing an ink-jet head 100 according to another embodiment of the invention. As depicted in FIG. 4, a method for manufacturing an ink-jet head 100 according to another embodiment of the invention can be used to form a structure in which the piezoelectric components 300 are held within a surface of the ink-jet head 100, to manufacture an ink-jet head 100 that has thinner actuators 600.

Figure 5:
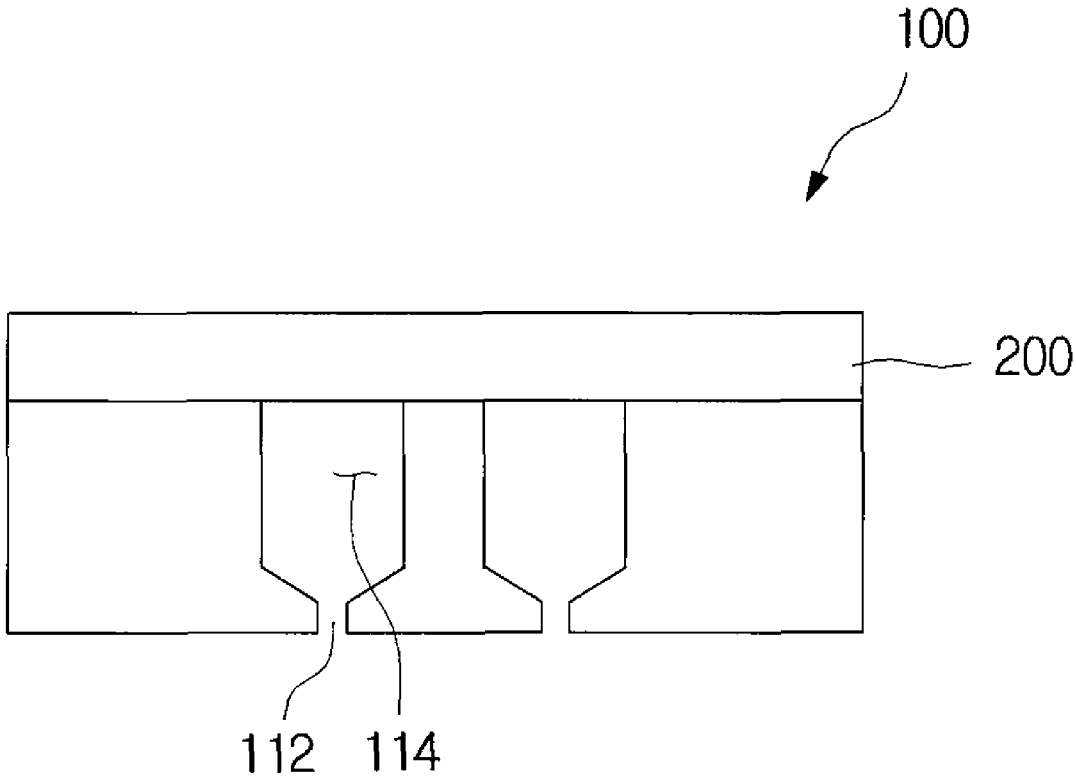
FIG. 5 is a front cross-sectional view of an ink-jet head according to another embodiment of the invention.

FIG. 5 is a front cross-sectional view of an ink-jet head 100 according to another embodiment of the invention. As in the example illustrated in FIG. 5, an ink-jet head 100, in which the actuators 600 are not yet formed, may first be prepared.

A chamber 114 for holding ink can be formed inside the ink-jet head 100, and a nozzle 112 for ejecting ink can be formed in a lower part of the chamber 114. The part on the opposite side of the nozzle 112, i.e. in a surface of the ink-jet head 100, can be where a membrane 212 may be formed in a subsequent process. This part can be made of a silicon wafer 200.

Figure 6:
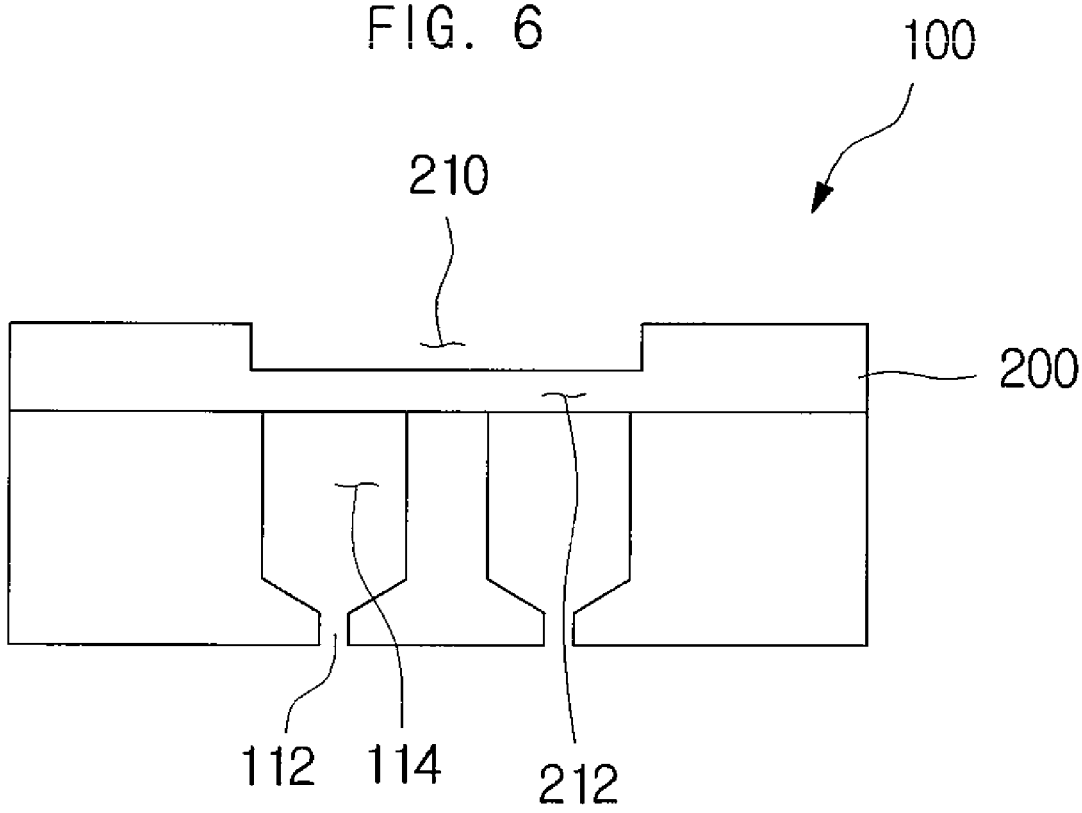
FIG. 6 is a front cross-sectional view of a holding cavity in an ink-jet head according to another embodiment of the invention.
Figure 7:
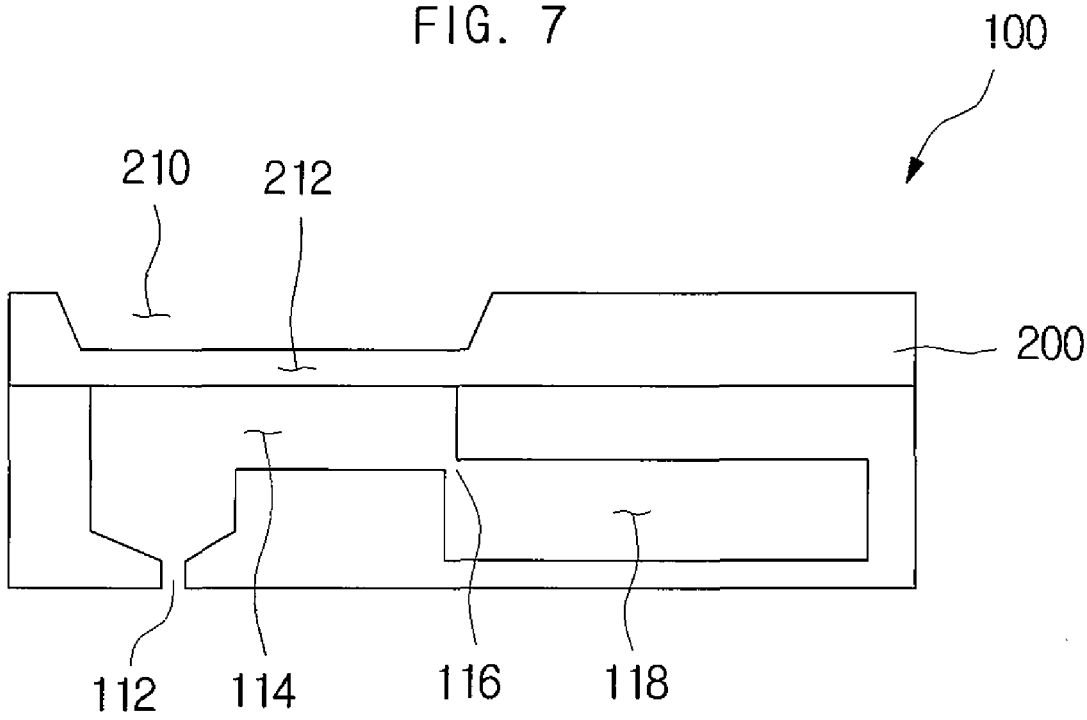
FIG. 7 is a side cross-sectional view of a holding cavity in an ink-jet head according to another embodiment of the invention.
Figure 8:
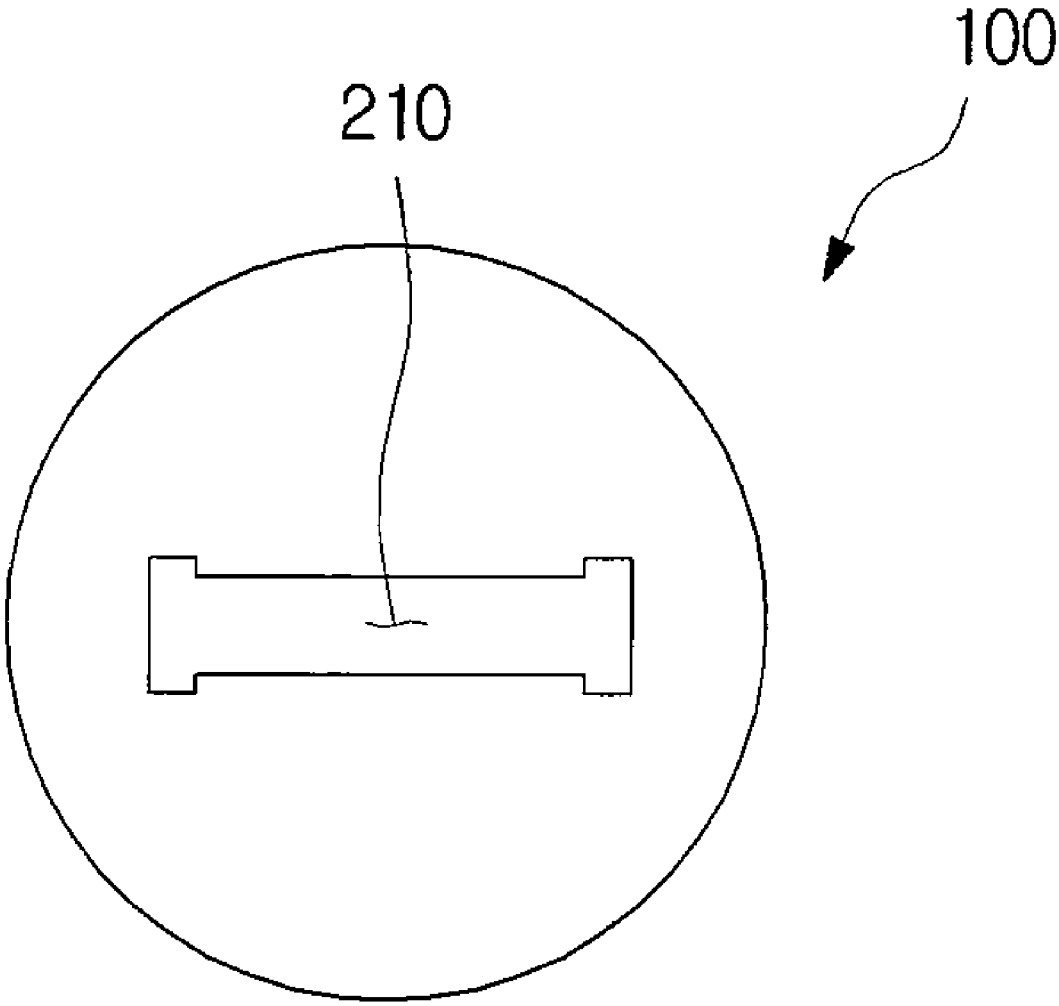
FIG. 8 is a plan view of a holding cavity in an ink-jet head according to another embodiment of the invention.

FIG. 6 is a front cross-sectional view of a holding cavity 210 in an ink-jet head 100 according to another embodiment of the invention, and FIG. 7 is a side cross-sectional view of a holding cavity 210 in an ink-jet head 100 according to another embodiment of the invention. FIG. 8 is a plan view of a holding cavity 210 in an ink-jet head 100 according to another embodiment of the invention.

A surface of the ink-jet head 100 in which the membrane 212 is formed can be etched so as to form a holding cavity 210 in the surface of the ink-jet head 100 (Operation S100). As illustrated in FIG. 6, the ink-jet head 100 may include multiple chambers 114 formed in a row, and the holding cavity 210 may extend along the direction in which the multiple chambers 114 are arranged.

The holding cavity 210 can be formed by wet etching the silicon wafer 200 that forms the surface of the ink-jet head 100. Formed at both ends of the holding cavity 210 may be portions that extend in the frontward and backward directions of the ink-jet head 100. As illustrated in FIG. 7, these portions may be formed such that the side walls of the holding cavity 210 are inclined.

The bottom surface of the holding cavity 210 can cover the chambers 114 and can serve as a membrane 212 that transfers vibrations generated in the piezoelectric components 300 to the chambers 114. In the operation of forming the holding cavity 210, the thickness of the membrane 212 may be determined by controlling the thickness of the silicon wafer 200 being etched.

Figure 9:
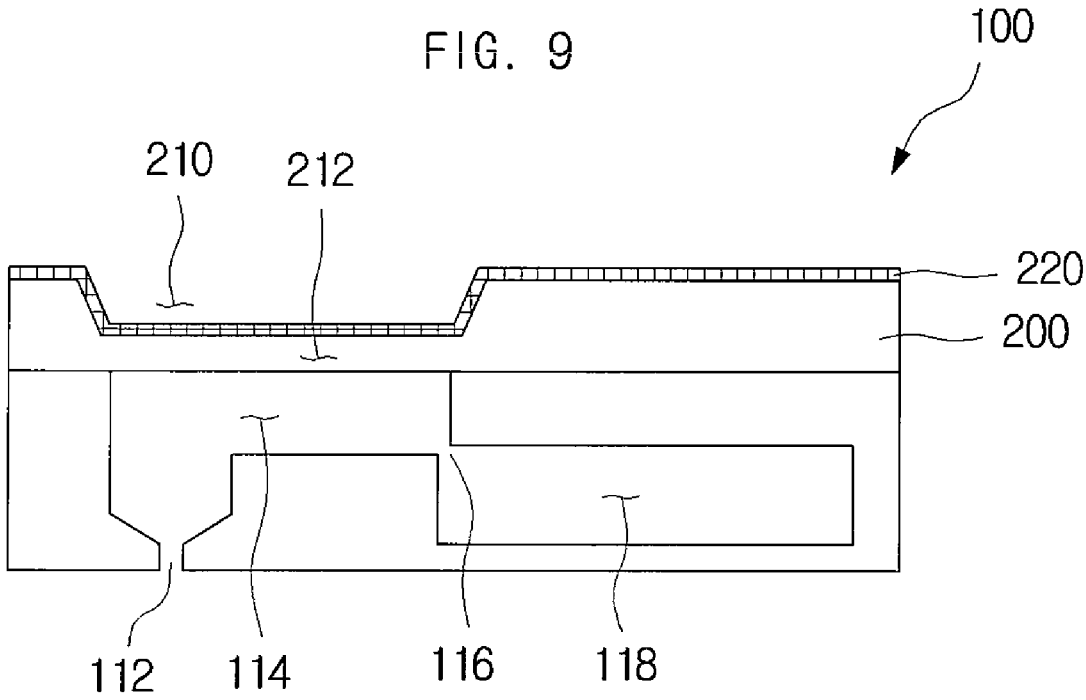
FIG. 9 is a side cross-sectional view of a lower electrode layer in an ink-jet head according to another embodiment of the invention.
Figure 10:
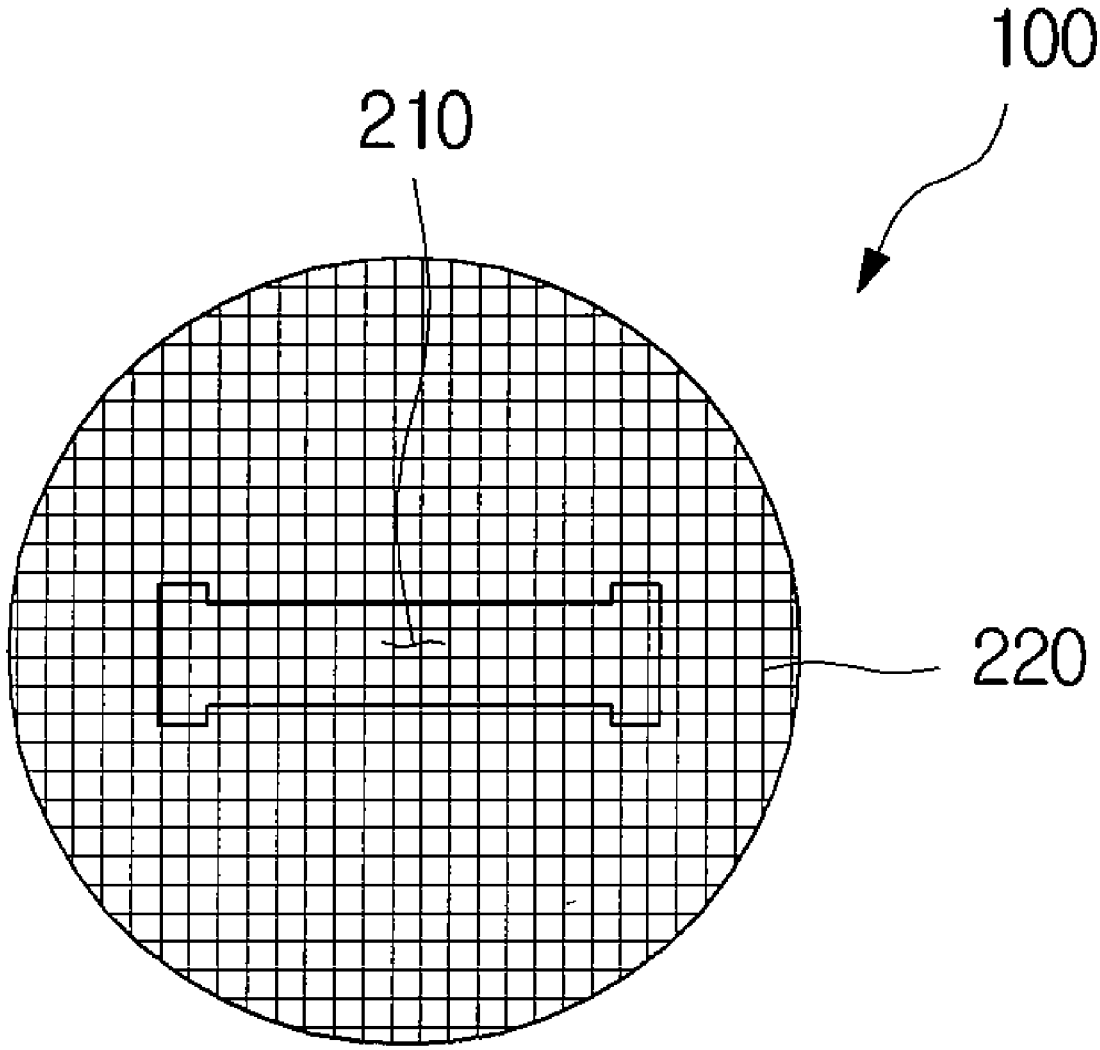
FIG. 10 is a plan view of a lower electrode layer in an ink-jet head according to another embodiment of the invention.

FIG. 9 is a side cross-sectional view of a lower electrode layer 220 in an ink-jet head 100 according to another embodiment of the invention, and FIG. 10 is a plan view of a lower electrode layer 220 in an ink-jet head 100 according to another embodiment of the invention.

As illustrated in FIG. 9 and FIG. 10, a conductive material can be deposited over the surface of the ink-jet head 100 in which the membrane 212 is formed so that a lower electrode layer 220 may be formed on an inner surface of the holding cavity 210 (Operation S200).

The lower electrode layer 220 can be formed over the entire surface of the ink-jet head 100 and can be formed over the bottom and side surfaces of the holding cavity 210 as well. The lower electrode layer 220 can be made from a material such as platinum (Pt) and titanium (Ti).

Figure 11:
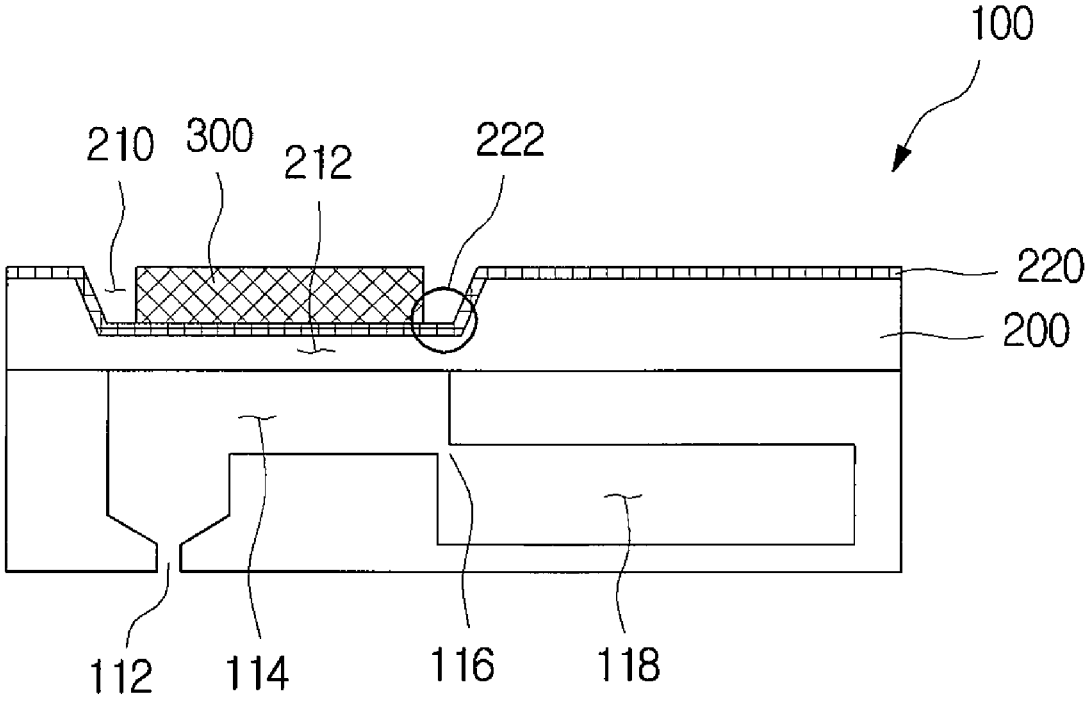
FIG. 11 is a side cross-sectional view of a piezoelectric component in an ink-jet head according to another embodiment of the invention.
Figure 12:
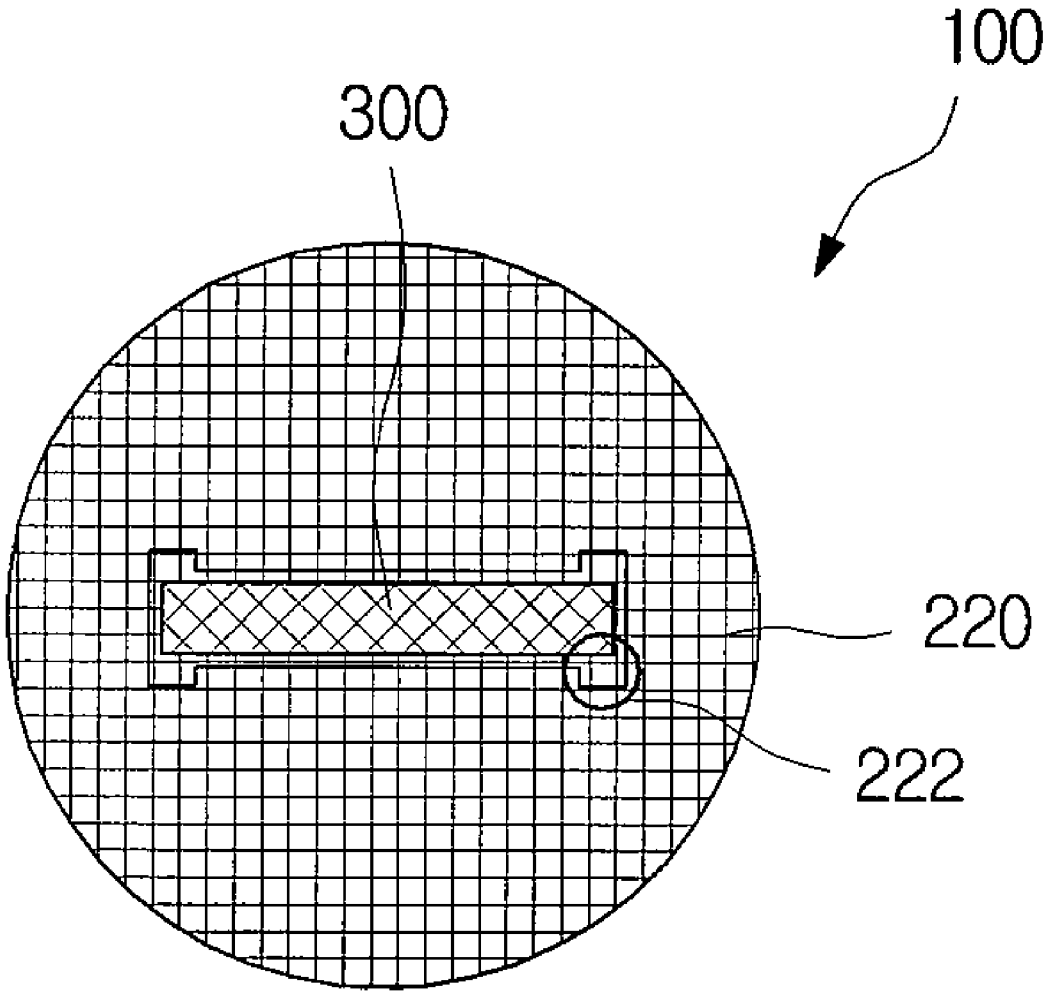
FIG. 12 is a plan view of a piezoelectric component in an ink-jet head according to another embodiment of the invention.

FIG. 11 is a side cross-sectional view of a piezoelectric component 300 in an ink-jet head 100 according to another embodiment of the invention, and FIG. 12 is a plan view of a piezoelectric component 300 in an ink-jet head 100 according to another embodiment of the invention.

As illustrated in FIG. 11 and FIG. 12, a piezoelectric component 300 can be mounted in the holding cavity 210 such that at least one side 222 of the lower electrode 221 is exposed (Operation S300). The piezoelectric component 300 can be of a bulk form, in which a piezoelectric material is cured together with a binder.

By way of the portions extending in the frontward and backward direction of the ink-jet head 100 at either end of the piezoelectric component 300, one side 222 of the lower electrode layer 220 formed on the bottom surface of the holding cavity 210 can be exposed. It is apparent that, when the mounting the piezoelectric component 300 on the bottom surface of the holding cavity 210, an adhesion layer may be interposed between the piezoelectric component 300 and the holding cavity 210.

The inner walls of the holding cavity 210 may be separated from the outer walls of the piezoelectric component 300 within a range that does not disrupt the alignment of the piezoelectric component 300 coupled onto the membrane 212. In this way, the inner walls of the holding cavity 210 may support the outer walls of the piezoelectric component 300 to improve the degree of alignment between the piezoelectric component 300 and the membrane 212.

Figure 13:
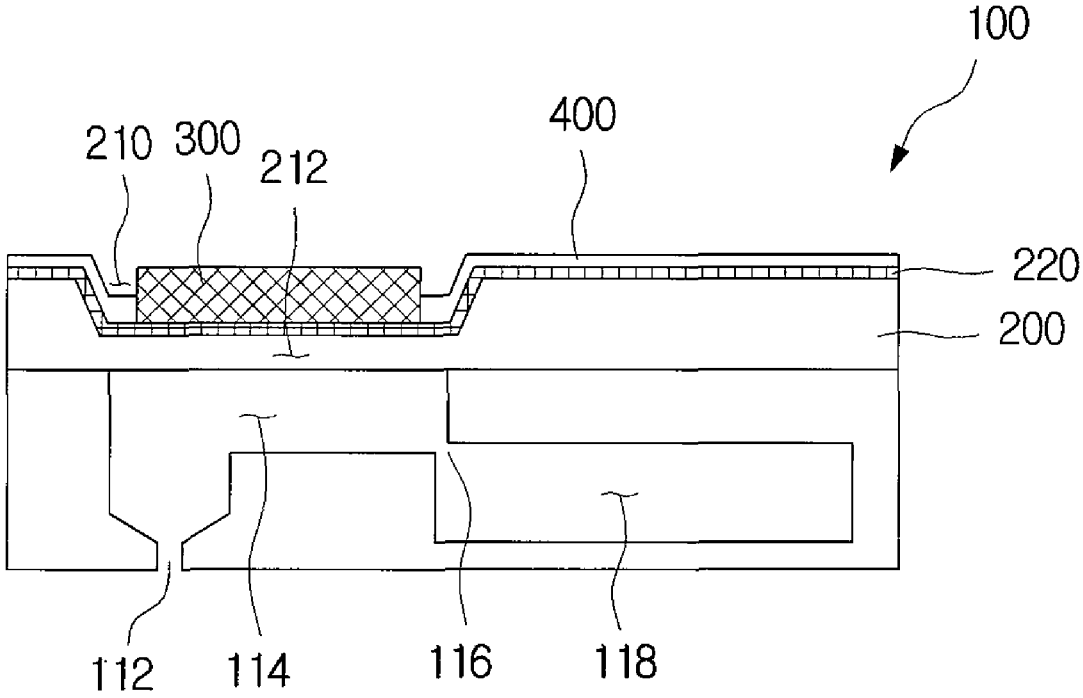
FIG. 13 is a side cross-sectional view of a connector layer in an ink-jet head according to another embodiment of the invention.
Figure 14:
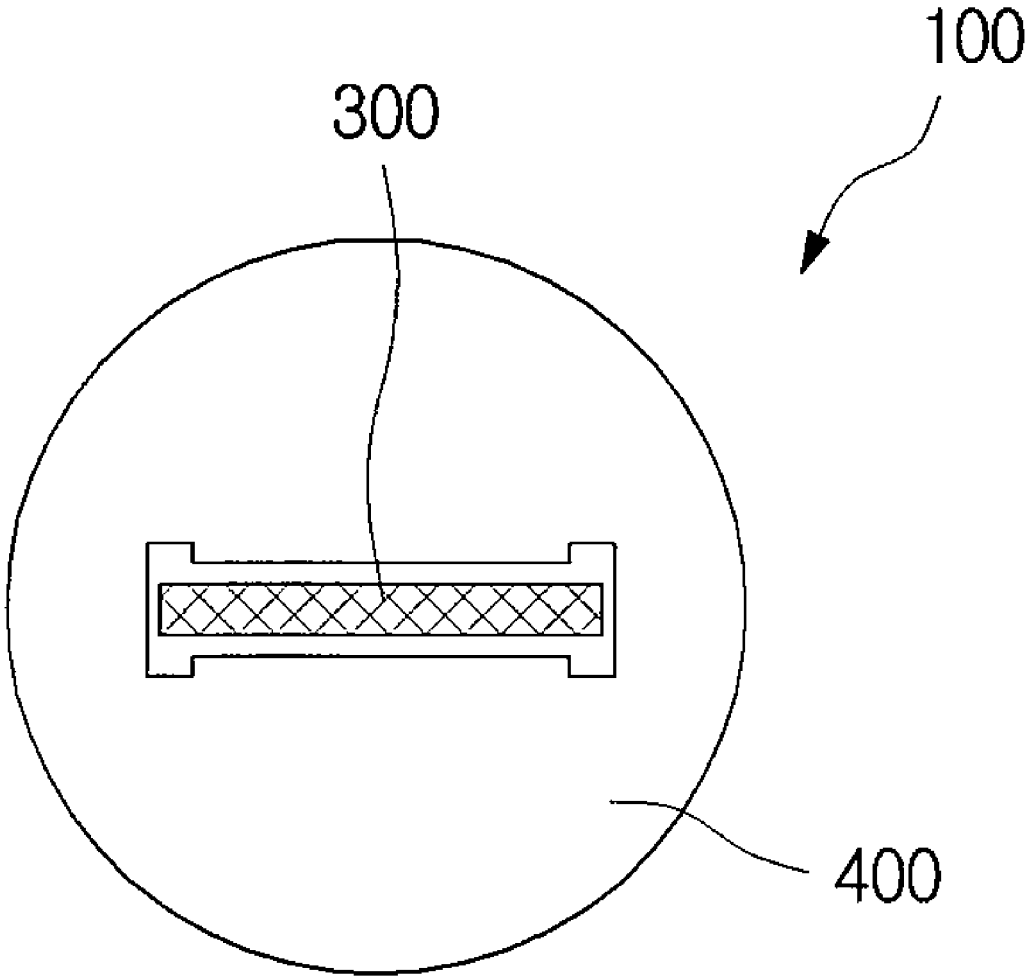
FIG. 14 is a plan view of a connector layer in an ink-jet head according to another embodiment of the invention.

FIG. 13 is a side cross-sectional view of a connector layer 400 in an ink-jet head 100 according to another embodiment of the invention, and FIG. 14 is a plan view of a connector layer 400 in an ink-jet head 100 according to another embodiment of the invention.

As illustrated in FIG. 13 and FIG. 14, electroplating can be performed over one side of the lower electrode 221 to form the connector layer 400 (Operation S400). The lower electrode layer 220 can be formed over the surface of the ink-jet head 100, excluding the portion where the piezoelectric component 300 is mounted. This lower electrode layer 220 can be used as a seed layer for performing electroplating over the surface of the ink jet head 100.

Here, the electroplating can be performed such that the thickness of the connector layer 400 formed in the holding cavity 210 is equal to the thickness that the piezoelectric component 300 is to have after a subsequent abrasion operation. In this way, the portions at the ends of the holding cavity 210 extending in the frontward and backward directions of the ink-jet head may be filled with a conductive material.

Figure 15:
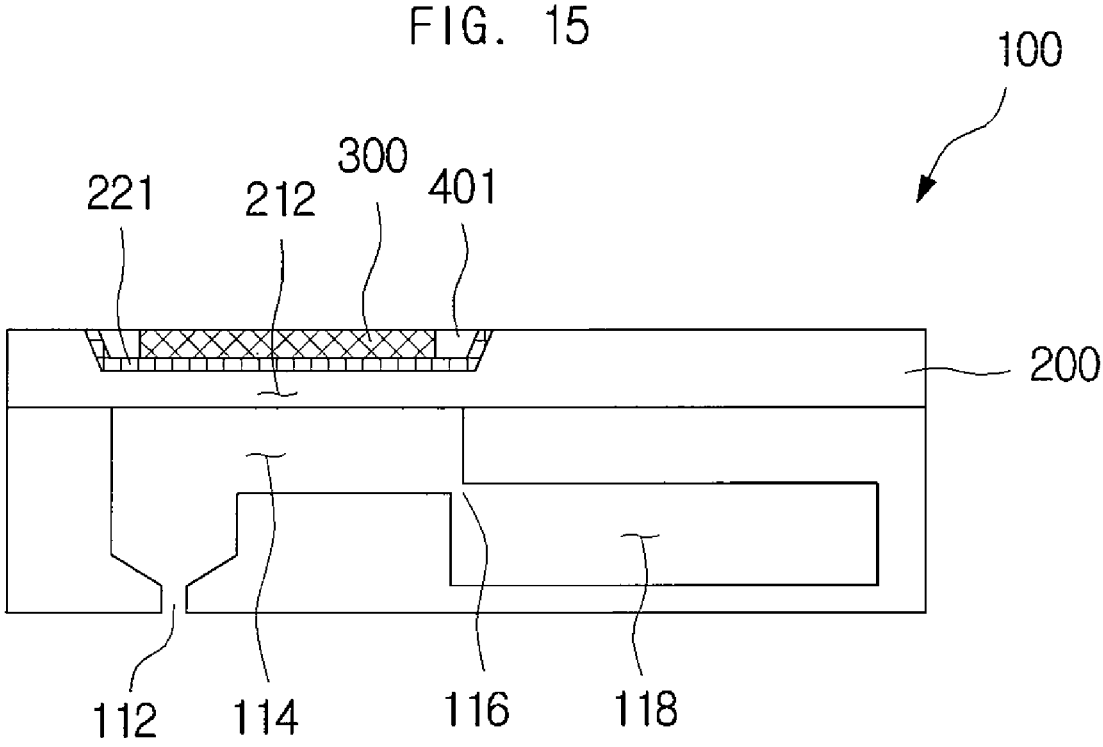
FIG. 15 is a side cross-sectional view of an abraded piezoelectric component in an ink-jet head according to another embodiment of the invention.
Figure 16:
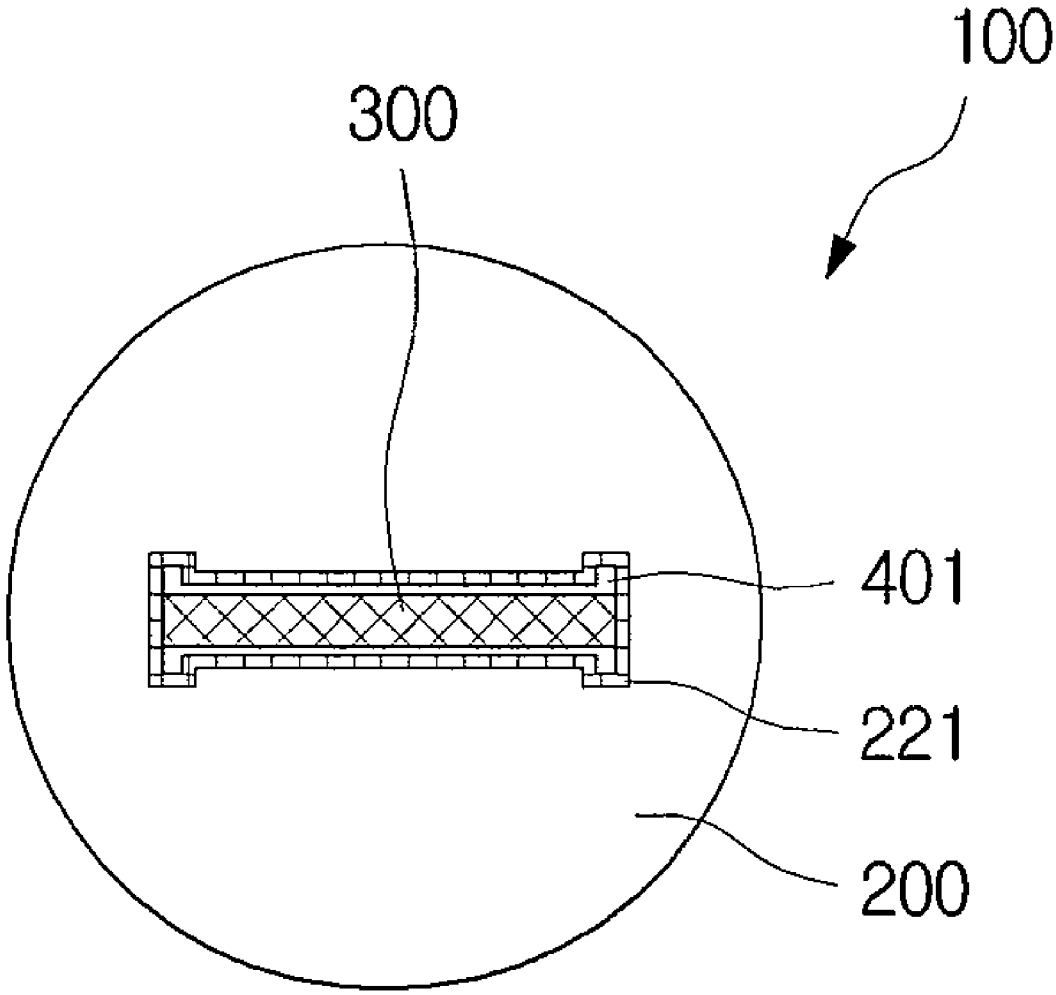
FIG. 16 is a plan view of an abraded piezoelectric component in an ink-jet head according to another embodiment of the invention.

FIG. 15 is a side cross-sectional view of an abraded piezoelectric component 300 in an ink-jet head 100 according to another embodiment of the invention, and FIG. 16 is a plan view of an abraded piezoelectric component 300 in an ink-jet head 100 according to another embodiment of the invention.

As illustrated in FIG. 15 and FIG. 16, a surface of the piezoelectric component 300, one end of the connector 401, and the surface of the ink-jet head 100 in which the membrane 212 is formed can be abraded such that the surface of the piezoelectric component 300, the one end of the connector 401, and the surface of the ink jet head 100 in which the membrane 212 is formed are level with one another (Operation S500).

The abrading operation can be performed such that the abraded piezoelectric component 300 obtains the desired thickness. Here, the lower electrode layer 220 and the connector layer 400 formed on the surface of the ink-jet head 100 can be removed, excluding the portions formed in the holding cavity 210.

Thus, the portion of the lower electrode layer 220 remaining in the holding cavity 210 may form a lower electrode 221, which may be coupled to the bottom surface of the piezoelectric component 300 to form an electrical connection with the piezoelectric component 300.

Also, the portion of the connector layer 400 remaining in the holding cavity 210 may form a connector 401, which may be coupled to one side of the lower electrode 221 to form an electrical connection with the lower electrode layer 220. Of course, the connector 401 can be exposed at the surface of the ink jet head 100.

Therefore, the connector 401 can serve as the medium that extends the electrical connection of the lower electrode 221 of the piezoelectric component 300 held in the holding cavity 210 to the surface of the ink-jet head 100. The inner walls of the holding cavity 210 may support the outer walls of the piezoelectric component 300 during the process of abrading the piezoelectric component 300, to prevent the outer walls of the piezoelectric component 300 from collapsing during the abrasion process.

Since the thickness of the piezoelectric component 300 can be controlled to the required level by way of the abrading operation, the ink-jet head 100 may be manufactured such that the actuator 600 is made from a thinner piezoelectric component 300.

Figure 17:
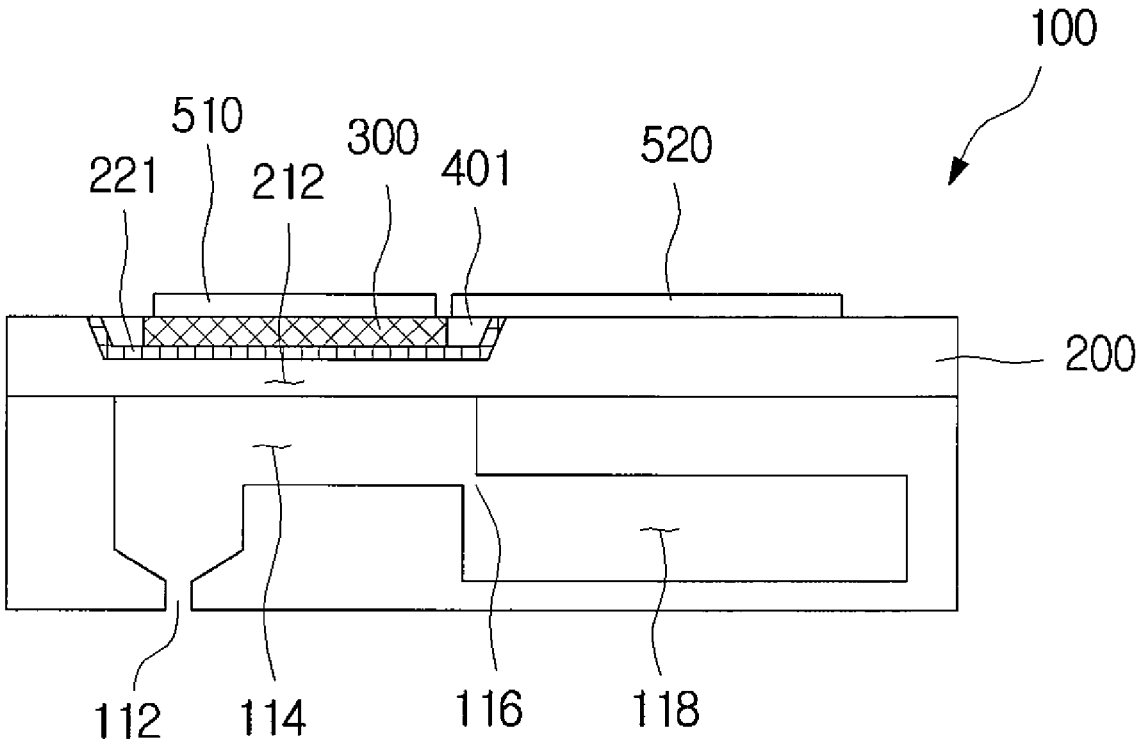
FIG. 17 is a side cross-sectional view of an upper electrode and a ground in an ink-jet head according to another embodiment of the invention.
Figure 18:
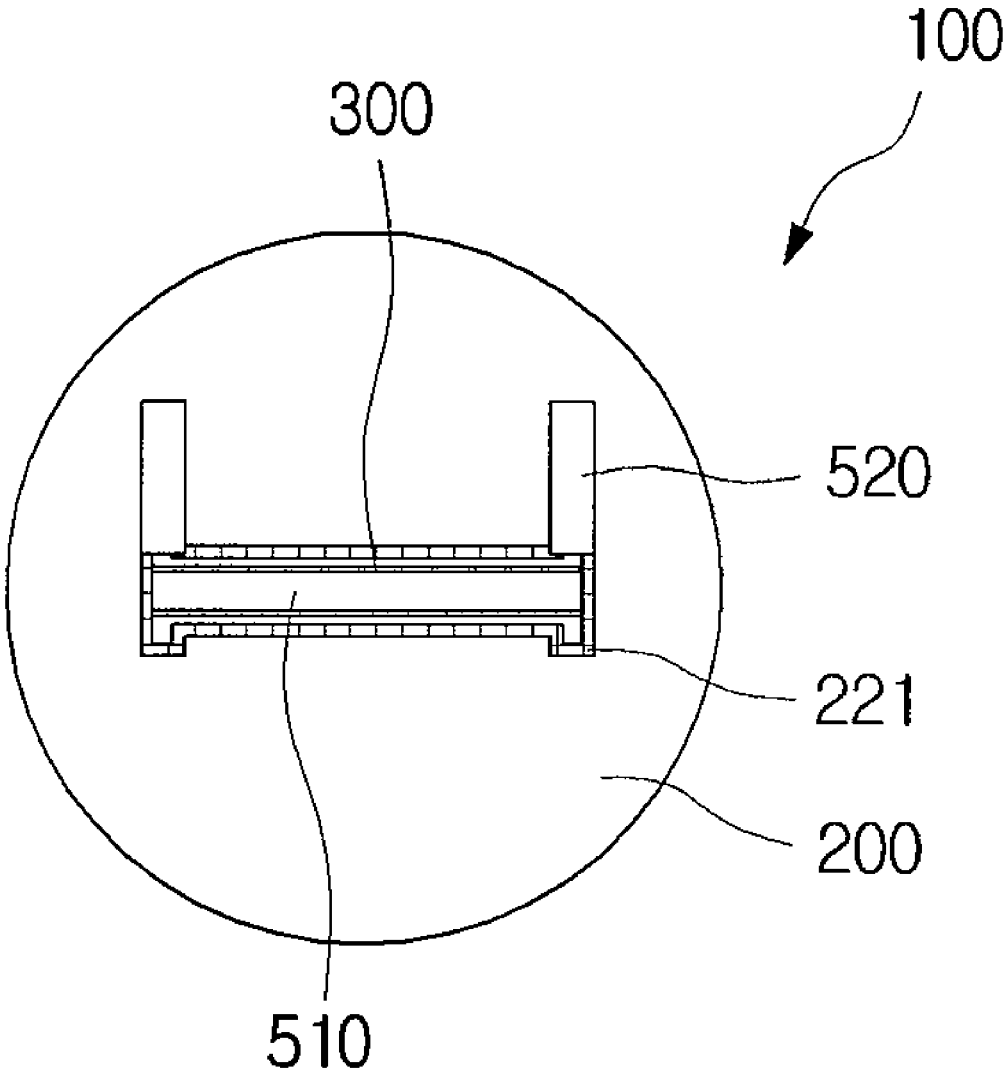
FIG. 18 is a plan view of an upper electrode and a ground in an ink-jet head according to another embodiment of the invention.

FIG. 17 is a side cross-sectional view of an upper electrode 510 and a ground 520 in an ink jet head 100 according to another embodiment of the invention, and FIG. 18 is a plan view of an upper electrode 510 and a ground 520 in an ink-jet head 100 according to another embodiment of the invention.

As illustrated in FIG. 17 and FIG. 18, an upper electrode 510 can be formed over the piezoelectric component 300 (Operation S600), and a ground 520 can be formed on the surface of the ink-jet head 100 in which the membrane 212 is formed, such that the ground 520 is coupled to one end of the connector 401 (Operation S700).

The upper electrode 510 can be coupled to the upper surface of the piezoelectric component 300 to provide an electrical connection to the piezoelectric component 300. The upper electrode 510 can be formed, for example, by patterning or depositing a conductive material over the piezoelectric component 300, and can be given the form of a thick film.

When the upper electrode 510 is formed as a thick film, the electrical connections to the upper electrode 510 may increase the temperature evenly over the entire upper electrode 510. This can improve spreading at the ends of the wires made of lead, during a subsequent process of wire bonding the upper electrode 510, and therefore improve the reliability of the electrical connections.

The ground 520 can provide an electrical connection to the lower electrode 221 by way of the connector 401, and can be connected to an external grounding electrode of the ink-jet head 100. Similar to the upper electrode 510, the ground 520 can be formed by patterning or depositing a conductive material.

Since the upper surface of the piezoelectric component 300, one end of the connector 401, and the surface of the ink-jet head 100 can be formed on the same level, the operation of forming the upper electrode 510 (Operation 5600) and the operation of forming the ground 520 (Operation 5700) can be performed simultaneously in a single process. In this way, the manufacturing process can be shortened, and the productivity of the manufacturing process can be improved.

Afterwards, the piezoelectric component 300 and the upper electrode 510 can be segmented according to the positions of the chambers 114, as in the example shown in FIG. 2 and FIG. 3, to form multiple actuators 600 corresponding respectively to the chambers 114.

According to certain embodiments of the invention as set forth above, the ink-jet head can be formed with thin-film type actuators, and the electrical properties of the ink-jet head can be improved.

While the spirit of the invention has been described in detail with reference to particular embodiments, the embodiments are for illustrative purposes only and do not limit the invention. It is to be appreciated that those skilled in the art can change or modify the embodiments without departing from the scope and spirit of the invention.

What is claimed is:

1. An ink-jet head comprising:

a chamber housing ink;

a membrane formed on one side of the chamber, the membrane having a holding cavity formed in one surface thereof;

a lower electrode formed on an inner surface of the holding cavity;

a piezoelectric component held in the holding cavity;

an upper electrode coupled onto the piezoelectric component;

a connector, one end of the connector extending to a point that is level with one surface of the ink jet head having the membrane formed therein, the other end of the connector coupled to one side of the lower electrode; and a ground disposed on the one surface of the ink-jet head having the membrane formed therein such that the ground is coupled to the one end of the connector.

2. The ink-jet head of claim 1, wherein the piezoelectric component is held in the holding cavity such that one side of the lower electrode is exposed.

3. The ink jet head of claim 2, wherein:

the piezoelectric component is held in the holding cavity such that both sides of the lower electrode are exposed; and the other ends of the connectors are coupled to both sides of the lower electrode, respectively.

4. The ink-jet head of claim 1, wherein an upper surface of the piezoelectric component and the one end of the connector are formed on a plane that is level with the one surface of the ink-jet head having the membrane formed therein.

5. A method for manufacturing an ink-jet head having a membrane formed on one side of a chamber housing ink, the method comprising:

forming a holding cavity in one surface of the ink-jet head having the membrane formed therein;

forming a lower electrode on an inner surface of the holding cavity;

mounting a piezoelectric component in the holding cavity;

forming a connector to be coupled to one side of the lower electrode;

forming an upper electrode on the piezoelectric component; and forming a ground on the one surface of the ink jet head having the membrane formed therein such that the ground is coupled to the one end of the connector.

6. The method of claim 5, wherein the mounting of the piezoelectric component is performed such that one side of the lower electrode is exposed, and the method further comprises, after the mounting of the piezoelectric component, forming a connector on one side of the lower electrode by performing electroplating.

7. The method of claim 6, wherein the forming of the lower electrode is performed by depositing a conductive material on the one surface of the ink-jet head having the membrane formed therein, and the method further comprises, after the forming of the connector, abrading one surface of the piezoelectric component and the one surface of the ink-jet head having the membrane formed therein such that one end of the connector is exposed.

8. The method of claim 7, wherein the abrading is performed such that the one surface of the piezoelectric component, the one end of the connector, and the one surface of the ink-jet head having the membrane formed therein are level with one another.

9. The method of claim 5, wherein the forming of the holding cavity is performed by etching the one surface of the ink-jet head.

* * * * *